United States Patent [19]

Baker, Jr. et al.

[11] 4,319,366

[45] Mar. 16, 1982

[54] WASTE STORAGE APPARATUS

[76] Inventors: Roupen Baker, Jr., Governors Way, Barnstable, Mass. 02630; Michael N. Botvin, 8 Roseland Ter., Marstons Mills, Mass. 02648

[21] Appl. No.: 119,446

[22] Filed: Feb. 7, 1980

[51] Int. Cl.[3] ..... B63B 29/14

[52] U.S. Cl. ..... 4/323; 4/321; 4/431

[58] Field of Search ..... 4/300, 315, 317–323, 4/347, 484, DIG. 16, 420, 431–434, 449, 459

[56] References Cited

U.S. PATENT DOCUMENTS

| | | | |
|---|---|---|---|
| 1,042,271 | 5/1936 | Moore | 4/347 X |
| 2,951,251 | 9/1960 | Belden | 4/321 X |
| 3,118,146 | 1/1964 | Dorey | 4/484 |
| 3,320,621 | 5/1967 | Vita | 4/320 |
| 3,474,467 | 10/1969 | Stinson | 4/321 |
| 3,510,885 | 5/1970 | Murray, Jr. | 4/323 |
| 3,551,916 | 1/1971 | Reid | 4/321 |
| 3,663,970 | 5/1972 | Drouhard, Jr. | 4/321 X |
| 3,842,445 | 10/1974 | Jones | 4/321 |
| 3,860,978 | 1/1975 | Wirth | 4/DIG. 16 |
| 4,032,995 | 7/1977 | Kemper | 4/323 X |
| 4,159,550 | 7/1979 | Tobin, Jr. | 4/319 |

*Primary Examiner*—Stuart S. Levy
*Attorney, Agent, or Firm*—Blodgett & Blodgett

[57] ABSTRACT

Apparatus for disposing of the waste from a boat head, the apparatus consisting of a flexible container which may be readily connected and disconnected from the discharge of the head, thus allowing selective discharge to storage or to the sea.

3 Claims, 7 Drawing Figures

WASTE STORAGE APPARATUS

BACKGROUND OF THE INVENTION

It has been conventional practice in small boats to connect the toilet or "head" first to a through-hull fitting for drawing in sea water and secondly to a through-hull fitting for discharging the waste from the toilet to the sea, the operation taking place by the manual or electrical operation of a combination pump and valve assembly. This assembly draws in fresh sea water, flushes it through the head, and forces it out into the sea again. In recent years, environmentally-concerned persons have importuned the Coast Guard and other government regulatory agencies to put a stop to the discharge of head waste into the sea, particularly in parts of the sea closely adjacent to land, most particularly in rivers and harbors. As a result of this pressure, laws have been passed by Congress with a definite date set up at which time such discharge will no longer be allowed. The only alternatives available will then be storage of the waste or a chemical treatment such that discharge into the ocean consists only of wastes in which all bacteria have been killed. The chemical treatment heads are quite expensive and, for the matter, so are storage facilities. The Environmental Protection Agency has specified that the only allowable waste disposable systems are Type II or Type III, the latter being the holding tank type. Some municipalities may insist that only the Type III will be allowed. Several problems arise with the holding tank system, whether the apparatus is provided during the construction of a new boat or is retro-fitted to older boats. Most boats under 35 feet long simply do not have room for a holding tank and what space is available is not rectilinear in shape, thus introducing problems in constructing an inexpensive holding tank. Another problem with a permanent holding tank is that pump-out stations are practically nonexistent and, when they are available, are quite expensive. These and other difficulties experienced with the prior art devices have been obviated in a novel manner by the present invention.

It is, therefore, an outstanding object of the invention to provide a waste storage apparatus particularly adapted to use with the head of small boats.

Another object of this invention is the provision of an apparatus for storing waste from a boat head, which apparatus will be acceptable to governmental and municipal agencies.

A further object of the present invention is the provision of an apparatus for converting a sea-discharge type boat head into a holding tank type.

It is another object of the instant invention to provide a waste storage apparatus which can make use of irregular spaces in small boats.

A still further object of the invention is the provision of a waste storage apparatus of such a nature that waste can be carried to conventional domestic toilets and there is no need for large pumping stations.

It is a further object of the invention to provide waste storage apparatus which allows an alternative selection from holding tank operation to direct discharge to the sea, where the latter is legally permissable.

It is a still further object of the present invention to provide an apparatus for storage of waste from a boat head, which apparatus is simple in construction, which is inexpensive to manufacture, and which is capable of a long life of useful service with a minimum of maintenance.

Another object of the invention is the provision of an apparatus for waste storage which can be easily installed in a small boat by the owner.

With these and other objects in view, as will be apparent to those skilled in the art, the invention resides in the combination of parts set forth in the specification and covered by the claims appended hereto.

SUMMARY OF THE INVENTION

In general, the invention consists of a waste storage apparatus for use with a boat head having a first conduit connected to an inlet through-hull fitting and a second conduit connected to a discharge through-hull fitting, introduction and discharge of sea water taking place under the impetus of a pump. The apparatus is provided with a container formed of flexible material having a threaded nozzle. A three-way valve is adapted to be connected in the second conduit, so that a first opening of the valve is connected to the pump and a second opening is connected to the outlet through-hull fitting. A coupling device connects a third opening of the valve to the nozzle of the container.

More specifically, an intermediate portion of the coupling device is vented to the outside of the boat and the coupling device is connected to the nozzle of the container by a threaded cap, so that the connection is gas-tight but is readily disconnectable. The container is formed of a transparent, flexible polymer that is such a size as to permit it to be easily carried when full and flesible enough, so that it can be collapsed for storage when empty.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
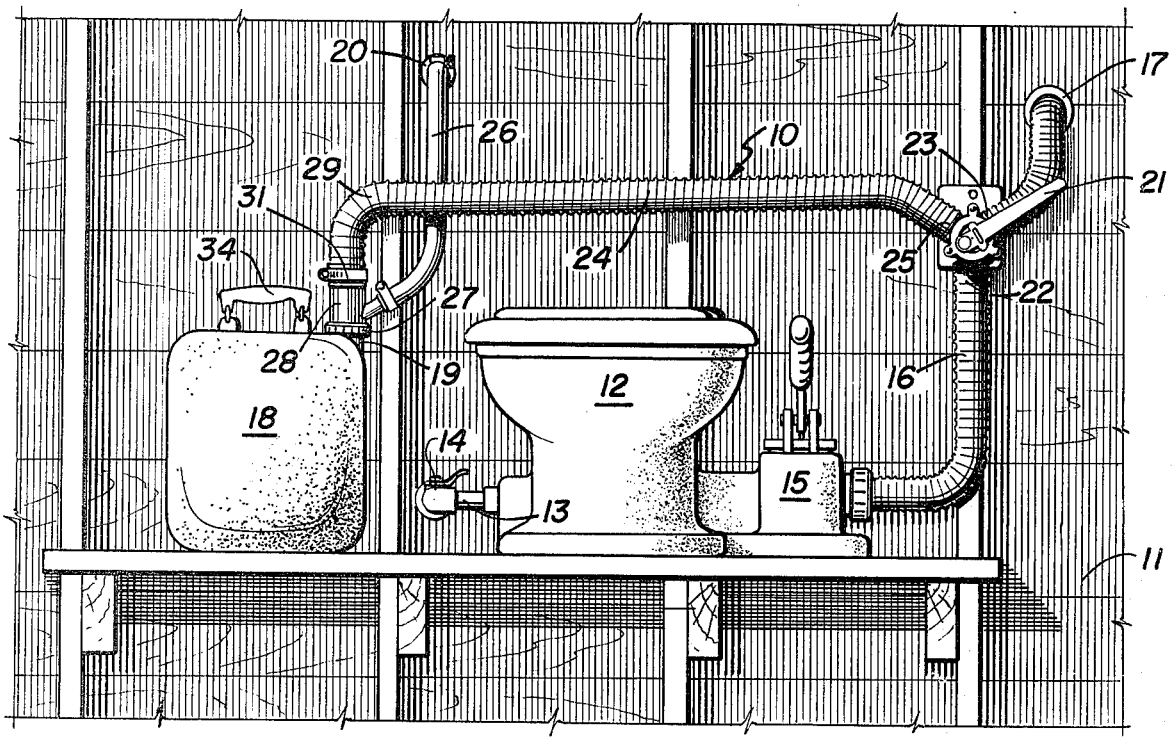
FIG. 1 is a front elevational view of waste storage apparatus embodying the principles of the present invention.
Figure 2:
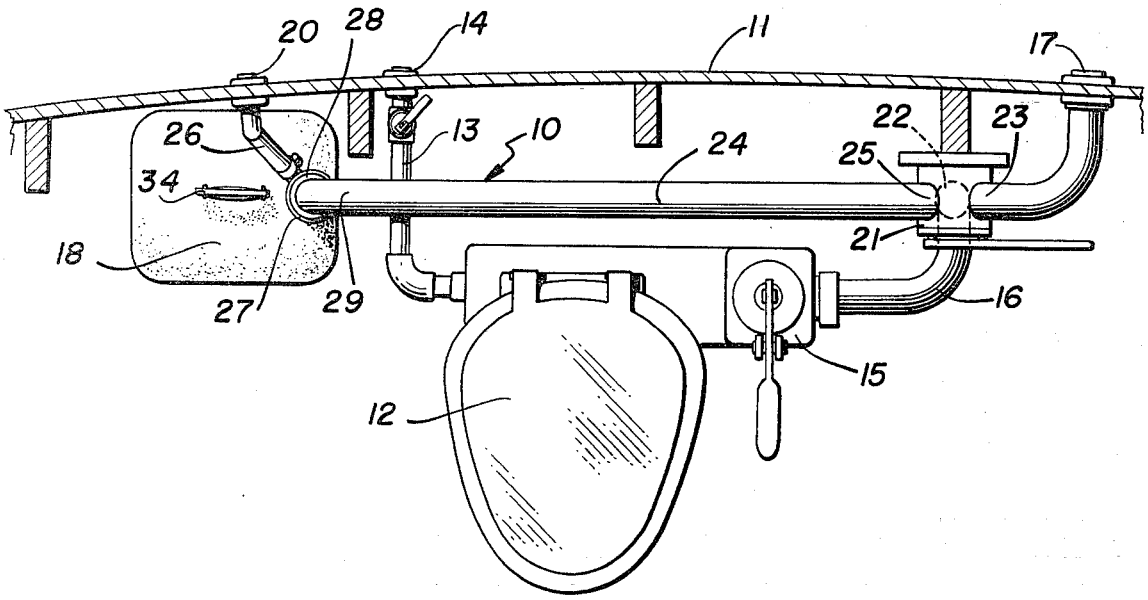
FIG. 2 is a somewhat schematic view of the apparatus.
Figure 3:
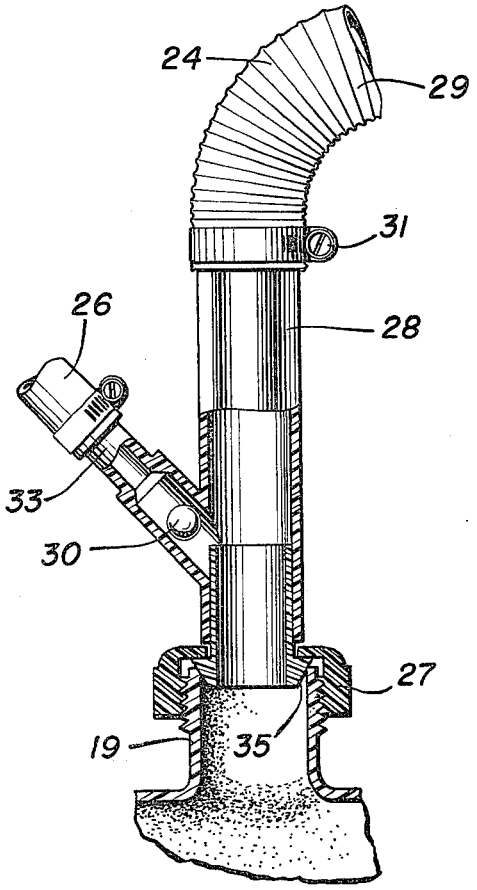
FIG. 3 is an enlarged sectional view of a portion of the apparatus.

Referring first to FIGS. 1 and 2, which best show the general features of the invention, the waste storage apparatus, indicated generally by the reference number 10, is shown in use with the toilet or head 12 of a boat 11. The head is connected in the conventional manner by a first conduit 13 to an inlet through-hull fitting 14. The heat is provided with a pump 15 which in the illustration is shown as hand-operated. The pump is connected in the usual way by a second conduit 16 to an outlet through-hull fitting 17.

The apparatus includes a container 18 formed of a flexible material, the container having a nozzle 19 provided with very coarse threads of the type having a square cross-section. A three-way valve 21 is connected in the second conduit 16 in such a way that a first opening 22 of the valve is connected to the pump 15 and a second opening 23 is connected to the outlet through-hull fitting 17. A coupling device 24 connects a third opening 25 of the valve to the nozzle 19 of the container.

An air vent tube 26 connects an intermediate portion of the coupling device 24 to a high point of the system, and preferably, to a through-hull fitting 20 located well above the water line. The coupling device 24 is connected to the nozzle 19 on the container by a threaded cap 27, so that the connection is liquid- and gas-tight. In the preferred embodiment, the container 18 is formed of a transparent flexible polymer, such a low-density polyethylene.

As is indicated in FIG. 2, the coupling device 24 is provided with a rigid, upwardly-extending portion 28 attached to the container and a flexible hose portion 29 attached to the three-way valve 21. A hose clamp 31 is used to connect the flexible portion 29 to the rigid portion 28. The lower end of the rigid portion 28 is provided with a radial flange which is engaged by the cap 27 and has a ground conical surface 35 which is clamped against the end of the nozzle 19 to provide for sealing. The flange and the surface 35 are formed on a separate fitting which is connected in the lower end of the portion 28 and partially blocks the entrance to the nipple 30 to retain the ball 30 in place.

Figure 4:
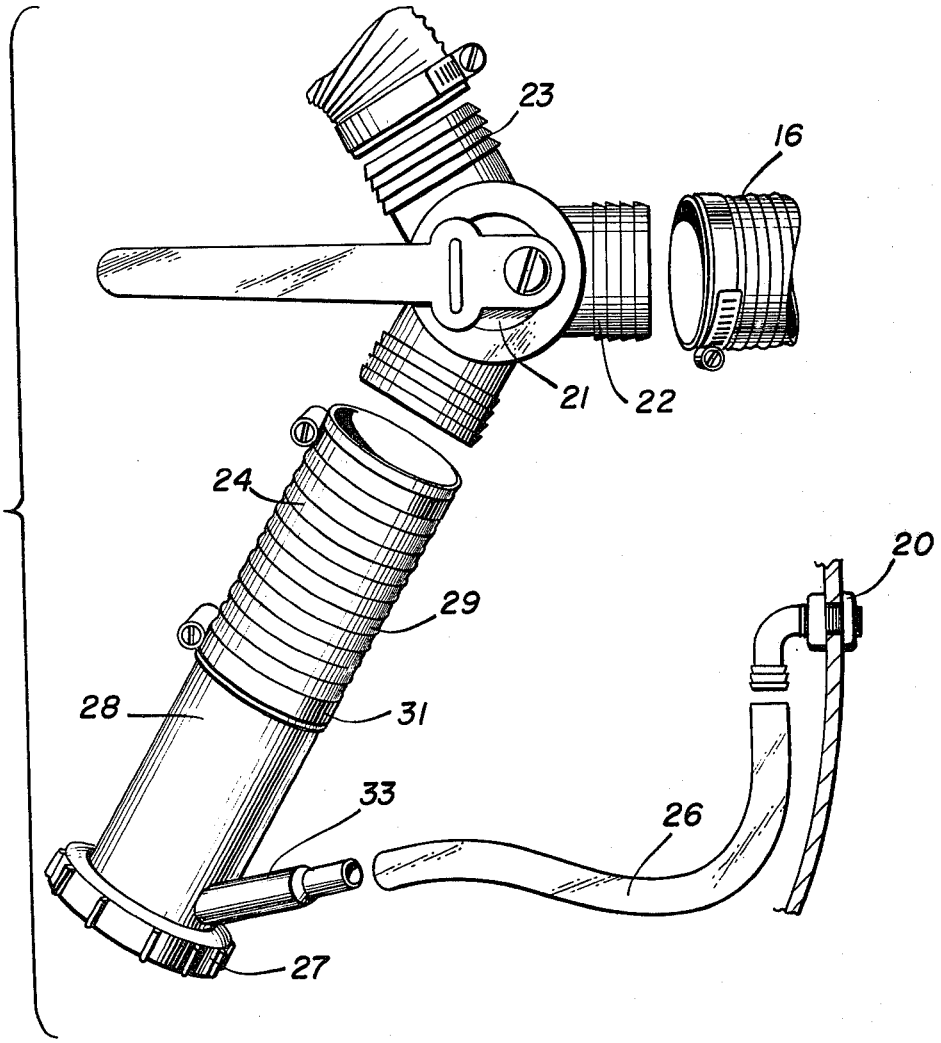
FIG. 4 is an exploded view of a portion of the apparatus.

FIG. 4 shows some of the details of the apparatus. The coupling device 24 and the two portions of the hose 16 are connected to the openings 25, 22, and 23 of the valve 21 by hose clamps. The rigid portion 28 of the coupling device 24 is provided with an integral nipple 33 which contains a check valve including a ball 30 to which one end of the air vent tube 26 is connected. The through-hull fitting 20 is generally L-shaped for convenient attachment to the other end of the tube 26.

Figure 5:
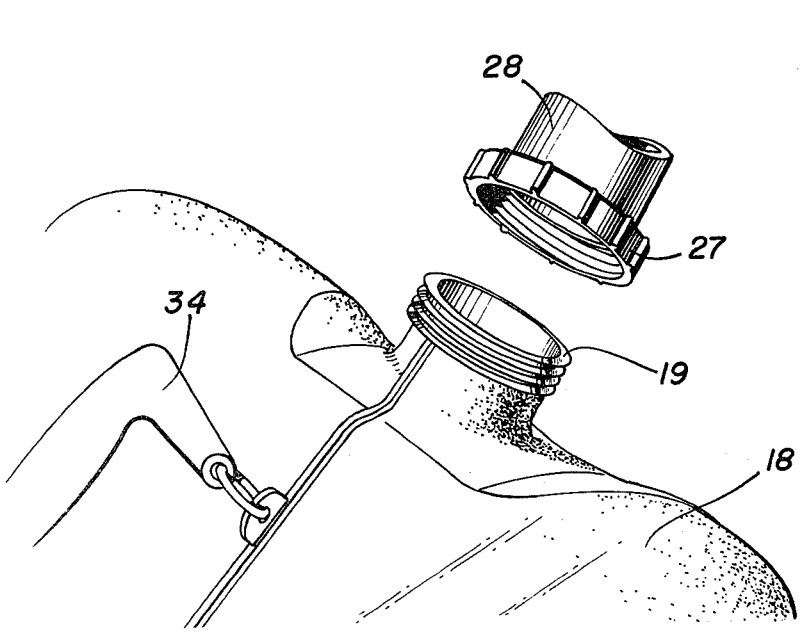
FIG. 5 is a perspective view of a portion of the apparatus.

FIG. 5 demonstrates the manner in which the rigid portion 28 with the cap 27 can be quickly and easily connected to or disconnected from the nozzle 19 of the container.

Figure 6:
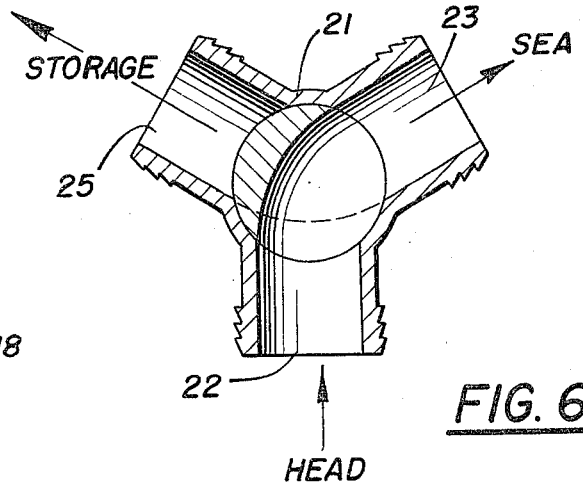
FIG. 6 is a sectional view of a valve forming part of the apparatus.

FIG. 6 demonstrates the internal construction of the three-way valve 21 and the manner in which movement of its handle connects the inlet opening 22 selectively to the opening 23 or the opening 25.

Figure 7:
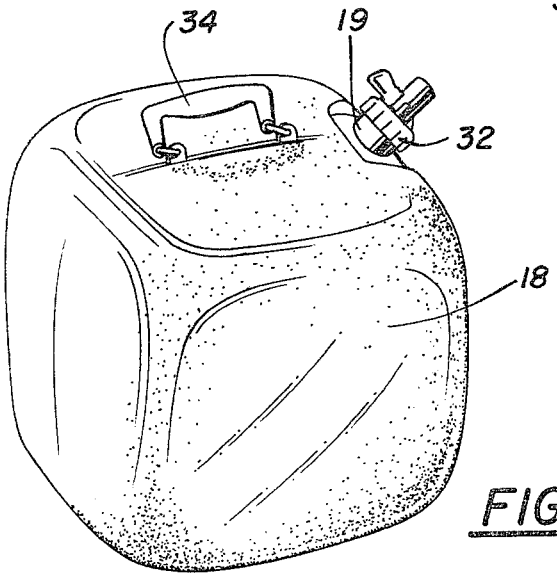
FIG. 7 is a perspective view of a container forming part of the apparatus.

FIG. 7 shows the general appearance of the container 18 and, particularly, shows the manner in which a cap 32 closes the nozzle 19 when the container is separated from the remainder of the apparatus. The container is provided with a handle 34 for convenience in carrying. The container is selected to be of a size that permits it to be easily carried when full. The flexible nature of the walls of the container allows it to be collapsed and folded for storage when empty.

The installation, operation, and advantages of the apparatus will now be readily understood in view of the above description. To install the apparatus 10 in the boat 11, it is necessary to cut the second or outlet conduit 16 that leads from the pump 15 of the head 12 to the through-hull fitting 17. If the boat is in the water, it will be necessary to close the head seacocks. The cut ends are clamped to the openings 22 and 23 of the three-way valve 21. One end of the flexible portion 29 of the hose 24 is clamped to the opening 25 of the valve, while the other end is clamped to the upper end of the rigid portion 28 by use of the hose clamp 31. The container 18 is placed on a suitable support in the boat and the lower end of the rigid portion 28 is connected tightly to the nozzle 19 by means of the cap 27. One end of the air vent tube 26 is shipped over the nipple 33, while the other end is fastened to the through-hull fitting 20. This last-named fitting should be located above the rub rail or shear line of the boat and, also, more than 6 feet above the discharge hose line.

The finished installation will permit the head 12 to be used in the usual way. At sea and where discharge is permitted, the handle of the valve is moved to the extreme position in which the opening 22 is operatively connected to the opening 23. Discharge then takes place through the fitting 17 into the sea. If such external discharge is not permitted (for instance, when the boat is in a harbor), the valve hand is moved to the extreme position in which the opening 22 is connected to the opening 25. The effluent from the head 12 and its pump 15 then pass into the container 18. The entry of the effluent into the system causes displacement of air and gas; this air passes through the air vent hose 26 and the fitting 20 into the atmosphere outside the boat.

When the container is full, the cap 27 is unscrewed from the nozzle 19 and the cap 32 is screwed tightly in its place. Before doing this the selector handle of the valve should be turned to the other position (sea discharge) and the head seacocks closed. The container can then be carried to a place of disposal by use of the handle 34. The discharge can take one of several forms. First of all, if the boat is at sea, it is possible to take the container on deck and emptying it over the leeward side. Secondly, if the boat is docked, the container and its contents can be carried ashore and disposed of as a unit; the container is of an inexpensive, disposable type, so that some users will prefer to substitute a new container for the old one. The final method (and the preferred one) is to carry the container and its contents ashore where the stored effluent will be emptied into a public or private toilet and flushed into a sewer line or septic system.

The advantages of the present waste disposal apparatus are apparent from the above description. The apparatus provides an inexpensive way for a boat owner to comply with Coast Guard regulations. The present apparatus conforms to Type III approved under 33 Code of Federal Regulations 159.12a, since this regulation states that devices used solely for the storage of sewage and flush water at ambient temperature and pressure are automatically certified by definition because the container 20 is formed of flexible material, it can be located in the boat in a irregular space that is not useful for any other purpose. Also, this flexibility means that it is not brittle and is not subject to being broken, which would be a very unpleasant occurrence. Since it is possible to carry the container out of the boat and discharge to a public or domestic toilet, it is not necessary to use an expensive pump-out service at the dock. Furthermore, such pump-out facilities are not always available. The apparatus can be readily installed by the boat owner, since no complex procedures are necessary for such an installation. Furthermore, the switchover from the "storage mode" to the "discharge mode" can be instantly made.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Waste storage apparatus for use with a boat head having a first conduit connected from the head to an inlet through-hull fitting, having a pump, and having a second conduit leading from the pump to an outlet through-hull fitting, comprising:

(a) a container formed of transparent flexible polymer having a threaded nozzle, the container being of a size to permit it to be easily carried when full and can be collapsed for storage when empty, (b) a three-way valve adapted to be connected in the second conduit so that a first opening of the valve is connected to the pump and a second opening is connected to the outlet through-hull fitting, (c) a hose connecting a third opening of the valve to the nozzle of the container, the hose being formed with a rigid, upwardly-extending portion attached to the container and a flexible portion attached to the three-way valve, a hose clamp being used to connect the flexible portion to the rigid portion, and (d) an air vent tube connecting an intermediate portion of the hose to a high point of the system.

2. Waste storage apparatus as recited in claim 1, wherein the hose is connected to the nozzle of the container by a threaded cap, so that the connection is gas-tight.

3. Waste storage apparatus as recited in claim 1, wherein a closure cap is provided to close the container during transport in full condition.

* * * * *